US007645217B2

(12) United States Patent
Habing et al.

(10) Patent No.: US 7,645,217 B2
(45) Date of Patent: Jan. 12, 2010

(54) ABDOMINAL EXERCISE BAR ACCESSORY AND METHOD USE

(75) Inventors: Theodore G. Habing, Tustin, CA (US); Mark A. Ulves, Anaheim Hills, CA (US)

(73) Assignee: Dream Visions LLC, Tustin, CA (US)

( * ) Notice: Subject to any disclaimer, the term of this patent is extended or adjusted under 35 U.S.C. 154(b) by 110 days.

(21) Appl. No.: 11/337,700

(22) Filed: Jan. 23, 2006

(65) Prior Publication Data

US 2007/0173389 A1 Jul. 26, 2007

(51) Int. Cl.
*A63B 26/00* (2006.01)

(52) U.S. Cl. ..... 482/140; 482/148

(58) Field of Classification Search ..... 482/140, 482/38–39, 62, 139, 148, 91, 907, 23
See application file for complete search history.

(56) References Cited

U.S. PATENT DOCUMENTS

| | | | | |
|---|---|---|---|---|
| 4,500,089 | A | 2/1985 | Jones | |
| 5,254,064 | A * | 10/1993 | Rock | 482/126 |
| 5,407,404 | A * | 4/1995 | Killian et al. | 482/38 |
| 5,766,118 | A | 6/1998 | Conner | |
| 5,871,424 | A | 2/1999 | Conner | |
| 5,910,073 | A | 6/1999 | Conner | |
| 6,015,372 | A | 1/2000 | Steffee et al. | |
| D439,938 | S | 4/2001 | Batca et al. | |
| 6,217,483 | B1 * | 4/2001 | Kallassy | 482/38 |
| 6,296,598 | B1 * | 10/2001 | Boland | 482/126 |
| 6,508,743 | B1 * | 1/2003 | Fortin | 482/41 |
| D486,535 | S | 2/2004 | Giannelli | |
| 2004/0033867 | A1 * | 2/2004 | Katami | 482/109 |
| 2005/0049115 | A1 * | 3/2005 | Gomez | 482/36 |
| 2006/0040802 | A1 * | 2/2006 | Vittone et al. | 482/106 |
| 2006/0100075 | A1 * | 5/2006 | Harsh | 482/142 |
| 2006/0211552 | A1 * | 9/2006 | Williams | 482/139 |
| 2006/0217246 | A1 * | 9/2006 | Payne | 482/96 |

* cited by examiner

*Primary Examiner*—Lori Amerson
(74) *Attorney, Agent, or Firm*—Jeffrey M Hersh

(57) ABSTRACT

An abdominal exercise bar accessory having a rigid bar that is placed against a user's chest and cradled within his underarm region, with two alternating upward and downward extending handles attached to the bar opposite the user so that the user's arms partially overlap while gripping the handles. A rigid side extension extends upward from the bar and is attached to an overhead resistance station, such as a cable-and-pulley weight system. The bar is preferably concave, but may be straight, and preferably includes cushioned pads. A method of use in which the user rotates and moves the bar downward from an upright sitting position towards the user's thighs, causing it to travel in a non-circular, non-uniform pathway that matches that of the user's natural body movements, then returns to an upright sitting position.

28 Claims, 6 Drawing Sheets

ABDOMINAL EXERCISE BAR ACCESSORY AND METHOD USE

BACKGROUND OF THE INVENTION

The field of this invention relates generally to exercise equipment and their methods of use, and more particularly to a concave-shaped abdominal exercise bar accessory that may be attached to an overhead cable-and-pulley apparatus, or similar device providing resistance, and the method of using the abdominal exercise bar.

A variety of abdominal exercise machines and devices have become a popular alternative to old-fashioned sit-ups and sit-ups on incline benches to better isolate the abdominal muscles while reducing strain on the neck and lower back.

Health clubs with a high volume of members often use large stand-alone variable-resistance abdominal weight exercise machines, which are large and expensive. These machines are quickly adjustable to the size of the user, which allows a high rate of users per hour. Typical configurations entail the user sitting upright and placing his chest or front of his shoulders against a pad or bar that pivots downward, placing resistance against the downward rotation motion using a cable and weight system. They usually include foot or knee restraints that prevent the user's legs and butt from rising up when heavy weights are employed. By allowing considerable weight resistance, the user can quickly isolate and exhaust the abdominal muscles.

These devices are sometimes awkward and uncomfortable to use, forcing the bar or shoulder pads to rotate downward along a fixed path. While the radius of the arc is generally adjustable, allowing for users of varying height, one's torso does not naturally bend or crunch downward along a circular arced path. This fails to maximize the isolation of the abdominal muscles, often causing the user to engage her hip flexors as the fixed pathway forces her to bend in an unnatural posture.

Another limitation of these machines caused by the bar or shoulder pads being fixed to a rotating cam is that the bar is forced to remain parallel to the ground. This requires the user to perform only symmetrical crunches, limiting the exercise to the abdominal muscle areas along the centerline of the body. These machines prevent the user from performing a twisting crunch that would enable the user to work out a larger area of the abdominal muscles.

Another category of abdominal exercise devices comprise pivoting benches or arm rails that essentially assist the user in performing sit-ups. Versions found in gyms typically include benches with a fixed bench portion and foot restraints. Those marketed for home use tend to comprise a rotating or rolling frame or arm rails only, with no bench, requiring the user to lie on the floor. These devices do not employ weights or other resistance means; instead, they are isometric exercise devices that rely on the weight of the user's torso and head. They are also single-exercise devices designed solely to work the abdominal muscles, but are far less expensive than the abdominal weight exercise machines.

One problem of this category of popular devices is that the user may need to perform hundreds of continuous repetitions to effectively work out the abdominal muscles. A single set may take 10 to 30 minutes, and sometimes results in the user reaching aerobic exhaustion prior to muscle exhaustion, or frankly, first exhausting one's patience, or that of another gym member waiting to use the apparatus. Such extensive repetitions may strain the user's neck and back. Furthermore, gym versions of this category of devices that have foot restraints often result in the user engaging his hip flexors more than the abdominal muscles.

Smaller gyms, such as in hotels or home that tend to have far less traffic, often utilize multiple-exercise apparatuses to which several different accessories may be attached to a single pulley-and-weight station. These enable the user to exercise a variety of different muscle groups depending upon which accessory is attached. Such multiple-station machines take up less space and are less expensive than supplying the equivalent array of stand-alone machines, but they accommodate substantially fewer users per hour. Such apparatuses typically have a pulley-and-weight station directed from the ground up, requiring the user to pull some form of handle or bar upward, and an overhead pulley-and-weight station in which the user pulls an attached handle or bar downward. Often a moveable seat or bench, sometimes with foot or knee restraints, may be situated beneath the overhead station. While a variety of accessory handles and bars currently available to isolate a number of muscle groups, none are particularly designed to be as easy, comfortable or effective for exercising the abdominal muscles.

There are a plethora of miscellaneous stand-alone designs that do not fit into the above categories, such as exercise balls and sliding benches. One particular miscellaneous design relevant to the present invention is shown in U.S. Pat. No. 5,766,118 issued Jun. 16, 1998 to Conner. It employs a padded bar that forms the lower, horizontal bar of a triangular shaped device in which the user places her arms and head through the triangular opening, and rests her arms over the padded bar, crossing them horizontally, generally parallel to and opposite the padded bar relative to her chest. The top of the triangular bar system is connected to an elastic band, which is attached to the top of a door. The user sits on a bench or chair, and rotates downward, pulling the bar towards her thighs or knees. The elastic band provides resistance during this rotation or crunch. This system is relatively inexpensive, compact and allegedly portable, requiring only a door and chair.

The Conner system, however, fails to provide readily adjustable resistance, requiring multiple elastic bands to be employed to increase the resistance, which is quite cumbersome compared to moving a pin on a stack of weights. The elastic bands also fail to provide consistent resistance throughout the range of motion of the crunch, thereby maximizing the force against the abdominal muscles over a limited range of motion despite its 90-degree range of motion. Furthermore, the device pulls the user forward, off the chair, because of the forward angle of the elastic bands due to its placement atop a door, instead of directly above the user.

SUMMARY OF THE INVENTION

It is an object of the present invention to solve the above-identified problems by providing an improved abdominal exercise bar comprising two handles that extend in a generally vertical and perpendicular direction from a longitudinal bar. When gripped, the handles position the user's forearms in a proper overlapping configuration along the same plane and parallel to the bar, opposite the user's chest, which rests against pads placed around the circumference of the bar. The handles are preferably L- or J-shaped, allowing them to provide a portion to grip that extends a few inches out from the bar in the direction opposite of the user's chest. The handles are preferably positioned about eight inches apart, allowing the user's forearms to overlap, and they are angled slightly towards the user and towards each other.

Although the bar of the present invention may be employed in a stand-alone abdominal weight machine in which the arm is fixed to a rotating cam or similar fixed structure, one object of the preferred embodiment of the present invention is to employ the abdominal bar as an accessory that may be attached to an overhead resistance station—typically a pulley-and-weight station in a universal or multi-exercise system. The handles preferably have one extending generally upward, and the other extending generally downward, thereby allowing each overlapping forearm to fall evenly along a single plane to ensure proper form in which equal force is applied to both arms, and in turn, shoulders, keeping the upper body symmetrically aligned.

One configuration of the present invention employs a standard, padded straight bar, but the preferred embodiment uses a bent or concave-shaped bar that wraps around the user's chest, thereby distributing the force of the bar more evenly across the chest and in a more comfortable angle through the user's underarm region. In combination with the position of the arms facilitated by the handles, the concave-shaped bar greatly reduces the uncomfortable pressure points of prior-art systems.

The preferred embodiment of the present invention configures the abdominal exercise bar as an accessory that may be attached to a standard overhead pulley-and-cable station. This configuration preferably employs two vertical side extensions that are perpendicularly attached to the bar. Thus, the side extensions extend vertically upward about seven inches when the bar is positioned parallel to the ground. Optionally, the bar may swivel or rotate along its longitudinal axis relative to the side extensions.

An angled extension, cable or strap is attached to the top of each side extension, and which are symmetrical and of equal length, meeting together about two feet from and adjacent to the center of the bar, thereby forming a V-shape. A fastener device, such as a ring, or spring link, is positioned at the top of the point at which the two side cables meet, permitting the abdominal accessory bar unit to be attached to any overhead resistance device, typically a pulley-and-cable weight system. This enables the accessory bar unit to be purchased alone, a considerable cost savings. It also saves space by allowing it to be used on a multi-exercise station along with other accessory bars and handles designed to work other muscle groups. Alternately, each side extension could be attached directly to a pulley on a dual pulley-and-weight station, or attached to them indirectly through an extension cable.

Another object of the present invention includes having the user place his head and arms through the house-shaped opening defined by the angled extensions and parallel side extensions. The side extensions are important to provide a large enough opening for the user to comfortably insert his arms and head through the opening without bumping against the angled extensions, or unduly contorting his neck or shoulders. The user then overlaps his forearms and grasps each handle, cradling the bar between his chest and underarm areas. The user then rotates his torso downward, pulling the bar downward towards his thighs. As the bar moves downward, the weights attached to the pulley are raised, or other resistance means is activated. The user may sit on a chair or bench.

A further object of the present invention pertains to advantages that result from having the bar accessory unit attached to a flexible cable instead of affixed to a rigid rotating cam on a stand-alone machine. This permits the user to move the bar freely during the crunch exercise, avoiding the restrictive circular arced pathway of standard rotating-cam type prior-art machines, permitting a more comfortable and natural motion that follows a non-circular arc. It also enables the user to perform a crunch in a twisting motion, enabling the isolation of a greater region within the abdominal muscles, particularly the muscles further away from the centerline of the torso. Such a twisting crunch may begin by the user facing symmetrically forward in the upright sitting position, begin crunching downward symmetrically along his centerline, then slowly and continuously twisting or rotating his torso and shoulders to either the right or left, thereby rotating the bar in the same direction, as the user continues to also rotate downward towards his thighs.

And yet another object of the present invention is to provide an abdominal exercise in which the user is forced to control the movement of the bar in all directions on its pathway downward, particularly how far it moves forward, in the direction away from the user's centerline, and in its rotation (or lack thereof) along the x-, y- and z-axes. This ensures better form, and engages a greater area of the user's abdominal muscles.

Other objects and advantages of the present invention will be described or become apparent as the preferred embodiment is shown in further detail in the drawings, and as described in the discussion below.

BRIEF DESCRIPTION OF THE DRAWINGS

The several features and advantages of the present invention will be better understood from a reading of the following detailed description in conjunction with the drawings, in which:

FIG. 1(*a*) shows a 3-dimensional perspective of the concave bar, handles, two side extensions, two angled straps, and attachment means of the abdominal exercise bar accessory unit of the present invention;

FIG. 1(*b*) shows an overhead perspective of the concave bar of FIG. 1(*a*);

FIG. 1(*c*) shows an a front view of the concave bar of FIG. 1(*a*);

FIG. 1(*d*) shows a side view of the concave bar of FIG. 1(*a*);

FIG. 2(*a*) shows a 3-dimensional perspective of the linear bar, handles, two side extensions, two angled extensions, and attachment means of the abdominal exercise bar accessory unit of the present invention;

FIG. 2(*b*) shows an overhead perspective of the linear bar of FIG. 2(*a*);

FIG. 2(*c*) shows a front view of the linear bar of FIG. 2(*a*);

FIG. 2(*d*) shows a side view of the linear bar of FIG. 2(*a*);

DETAILED DESCRIPTION OF THE DRAWINGS

1. Definitions

Figure 1A:
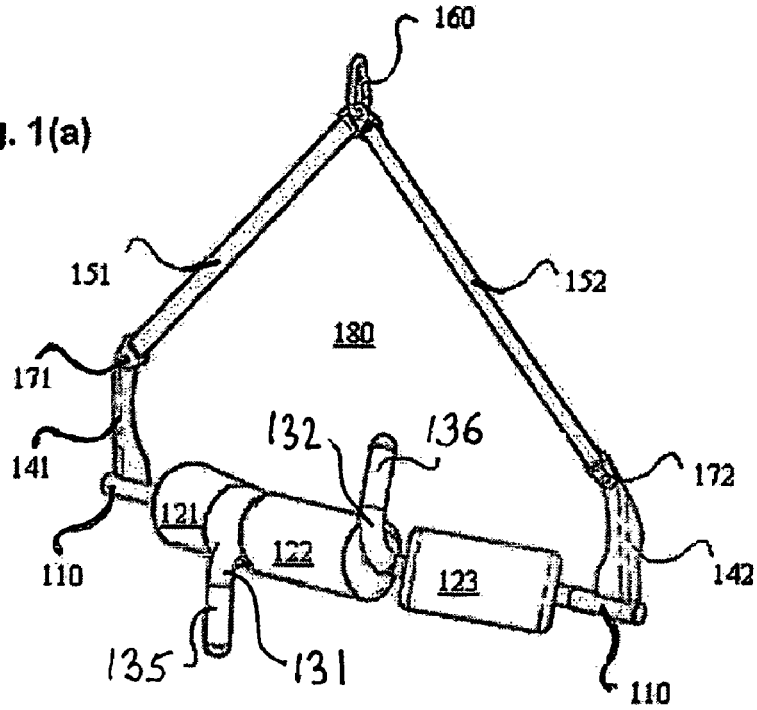
FIG. 1 includes four drawings of the preferred embodiment of the present Invention having a concave-shaped bar.
Figure 1B:
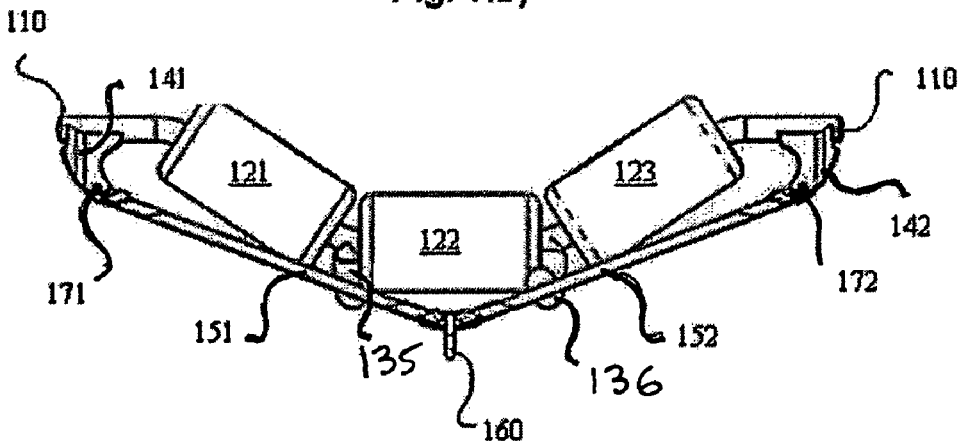
Figure 1C:
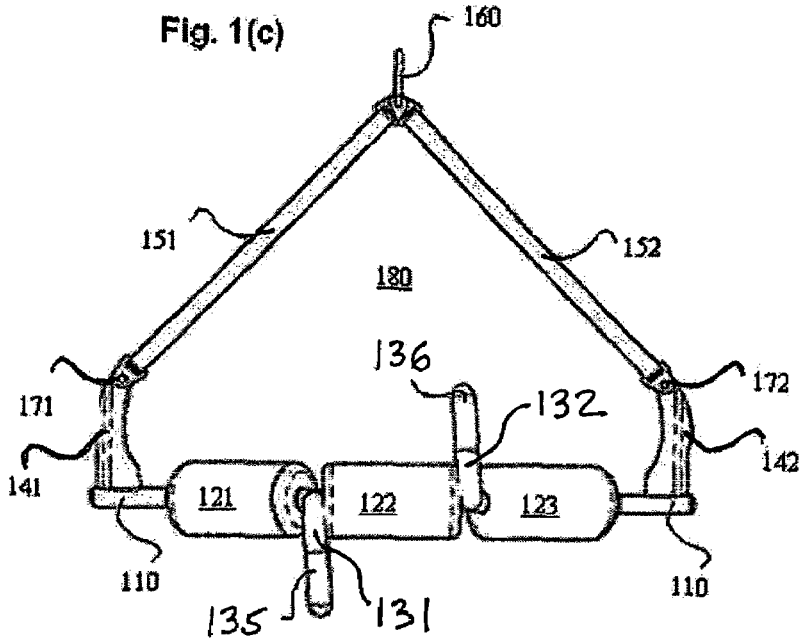
Figure 1D:
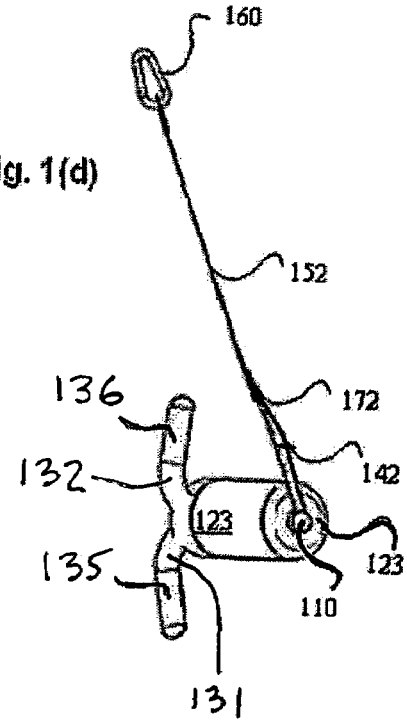

In this application and its claims, the term "concave" shall mean any non-linear shape that results in a rigid bar, or any padding that extends from the bar, making contact with the user at any three or more points along the user's chest or torso that together form a generally concave or curved shape of at least five degrees (relative to a linear shape, which has a 0-degree curve). The curve need not be a perfect concave shape mathematically, nor be free from distortions, but in general comprise a concave shape similar to the shape and contours of a human torso or chest. Thus the term "concave" shall be defined herein very broadly to include many non-linear shapes.

Due to simplicity of design and manufacture, the preferred embodiment of the present invention accomplishes this by a bar that contains three substantially linear portions, each bent relative to the other. While such a configuration would generally not be considered to possess a concave shape, the significant features for the purpose of the present invention is the relative positions of the points on a plurality of pads circumferentially attached to the bar that come in contact with the user's chest or torso. Because the pads bend and compress to a degree to the shape and contours of the user's body, each pad need not be curved but instead may be linear. When pressed against the user's chest or torso, each pad is compressed in a generally concave shape, and more importantly, the relative positions the center point of contact of each particular pad forms a generally concave shape. Thus, the term "concave" shall include, but not be limited to, this particular configuration.

However, the term "concave" shall specifically exclude a linear-shaped bar having non-uniform padding applied circumferentially or otherwise such that the points of contact between the padding and user's torso are non-linear or curved. Furthermore, the term "concave" shall specifically exclude any non-linear-shaped bar in which the non-linearity from the two most non-linear points is less than five degrees relative to the midpoint of the bar. In other words, the angle between the line between each of the two most non-linear points and the midpoint on the bar must be less than 175 degrees to meet the definition of "concave" as used herein.

In this application and its claims, a dimensional coordinate system consisting of an x-, y- and z-axis—each of which is perpendicular to the other two—is used as a reference. Each axis, or dimension, shall mean the relative position or direction of two points or objects. For example, the longitudinal dimension of the straight bar is arbitrarily assigned as being the x-axis (and in the case of the concave bar, the x-axis is defined as the longitudinal dimension of the concave bar at its center). If the bar is positioned horizontal to the ground—its general position—then the y-axis is defined as being horizontal, and the z-axis is defined as the vertical direction, both the y- and z-axes being perpendicular to the x-axis. However, the x-, y- and z-axes are defined as relative to the bar, not to the ground or 3-space, so that the x-axis is always the longitudinal dimension of the bar, regardless of its angle relative to the ground. Accordingly, the z-axis is not always orthogonal to the ground, and would be parallel to the ground if the bar is positioned sideways, or vertically.

The hand-grip portions of the handles are then said to be positioned more than a specified distance (e.g., at least one inch) from the bar along the direction of the y-axis, and angled such that its longitudinal direction is within a specified angle (e.g., 30 degrees) of the z-axis. In other words, if a person cradles the bar within their underarm region, the y-axis would extend orthogonally from the person's chest such that the hand-grip portions are positioned at least one inch from the bar opposite the person's chest, and angled generally upward, in the direction of the person's torso, in the direction of the z-axis, albeit with the ability to be angled within 30 degrees of the z-axis. Note that the angle of the hand-grip portions may be within 30 degrees in the direction towards the x-axis, and/or in the direction towards the y-axis.

2. The Structure of the Invention

Identical reference numerals in the drawings denote the same elements throughout the various drawings. Note that reference numerals for corresponding components of the two embodiments shown the drawings in FIGS. 1 and 2, respectively, differ by exactly 100, with components in FIG. 1 being in the 100s-range, and those in FIG. 2 being in the 200s-range. However, the various drawings are not drawn to scale, but for illustrative purposes of the basic relative positions of the various components.

Figure 2A:
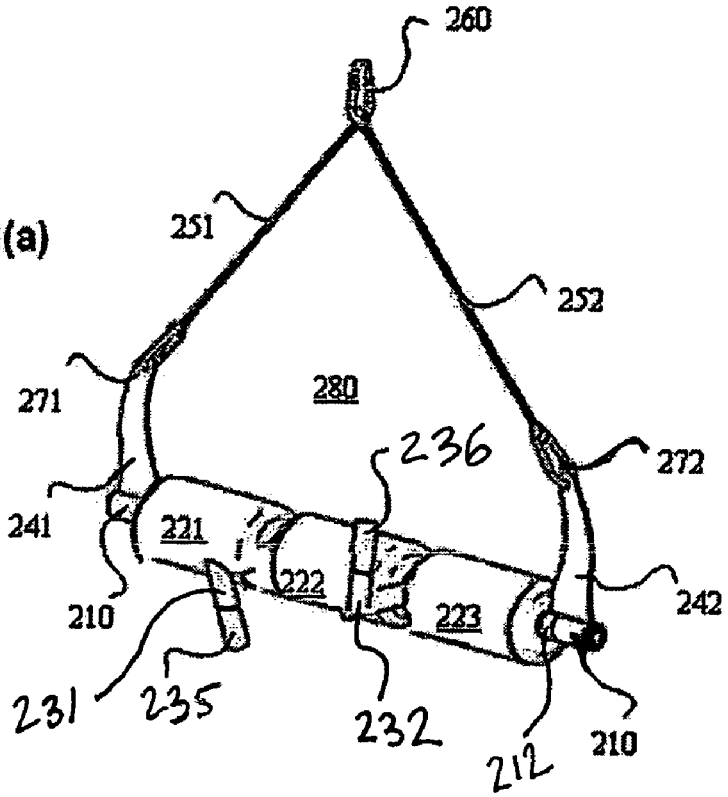
FIG. 2 includes four drawings of a simplified, alternate embodiment of the present invention having a straight- or linear-shaped bar.
Figure 2B:
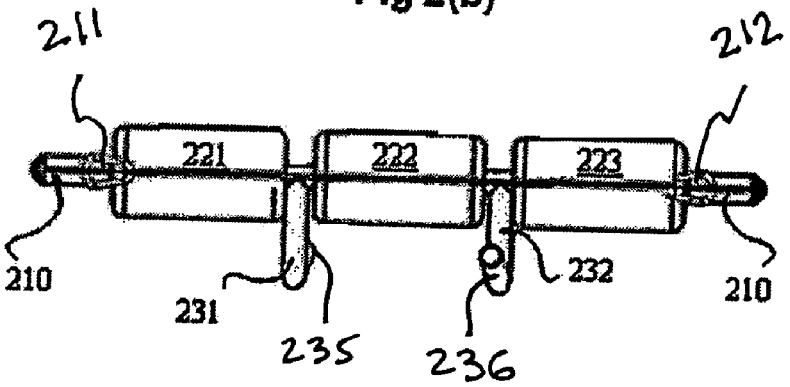
Figure 2:
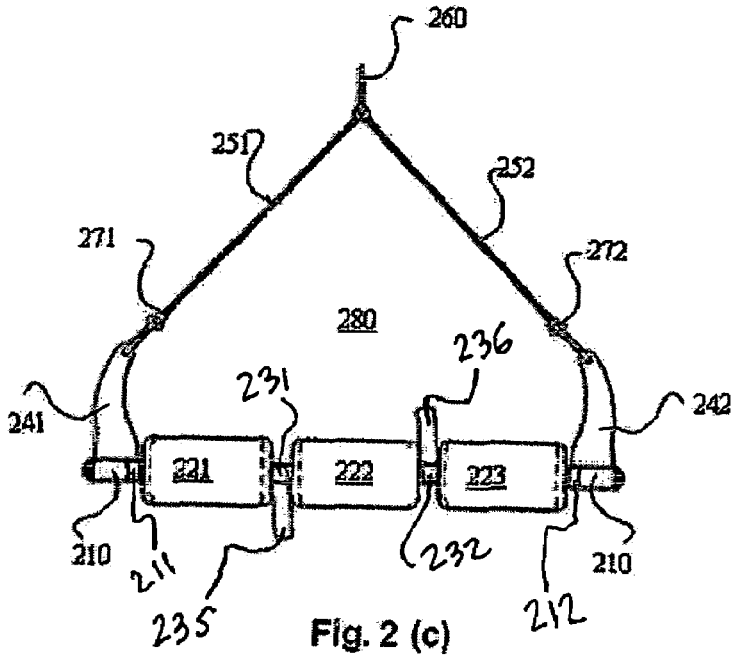
Figure 2:
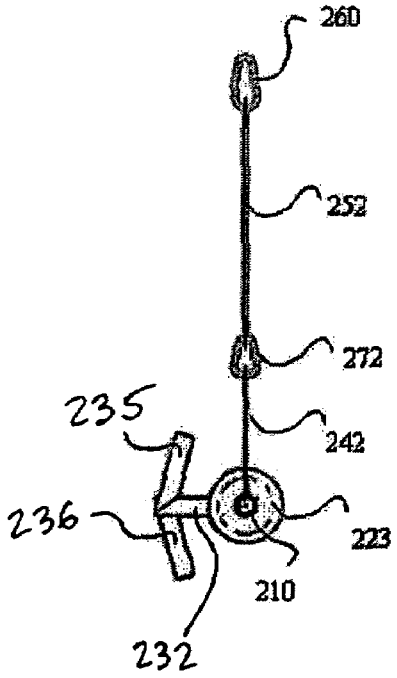

While the preferred embodiment of the present invention is depicted in the four drawings of FIG. 1, we begin the discussion of the core inventive concept of the present invention by reference to the simplified linear embodiment shown in the drawings in FIG. 2. The core inventive concept—though not the sole inventive concept—comprises the combination of straight bar 210, which is comprised of a rigid material, preferably a metal or alloy, with handles 231 and 232, which are made of a similar rigid material. Alternately, straight bar 210 may be comprised of a molded plastic or padded wooden material. Handles 231, 232 are equidistant from the center of straight bar 210 with the grip portions extending somewhat vertically. Handles 231, 232 are positioned outward from straight bar 210 about three inches opposite the side the user's chest rests against.

The preferred embodiment shows L-shaped handles 231, 232 to accomplish this position, although those skilled in the art will understand that various alternate shapes and configurations of handles could be used to provide the same relative position of grip portions 235, 236 of handles 231, 232. (For example, FIG. 1 shows J-shaped handles 131, 132—either may be used in either the straight-and concave-bar configurations.) Handles 231, 232 have hand-grip portions 235, 236 that are substantially linear, and which are the portions of handles 231, 232 in which the user's hands grasp.

One or more foam-filled pads—here shown as three separate pads 221, 222, 223—are circumferentially attached to straight bar 210 to provide a cushion between the user's chest and the hard metal of straight bar 210. Alternately, straight bar 210 could be manufactured with a rubberized coating or other material that provides a dampening or cushioned effect, or could be padded on the upper side only. The distance that handles 231, 232 extend out from straight bar 210 depends upon the thickness of straight bar 210, and the thickness of any pads 221, 222, 223 attached thereto, so that hand-grip portions 235, 236 extend about six inches out from the plane defined by the front of the user's torso that presses against pads 221, 222, 223.

In the preferred embodiment, each of hand-grip portions 235, 236 extend vertically in opposite directions from the horizontal plane defined by straight bar 210 when it is positioned horizontally, that is, parallel to the ground, as shown in FIGS. 2(*c*) and 2(*d*). The purpose of this alternating or asymmetric handles is to permit the users forearms to overlap while remaining parallel to each other, positioned along a plane that is parallel to the plane defined by the user's chest when in the upright position. Accordingly, the user's elbows are bent slightly, one up and the other down, but the user's upper arms remain parallel and symmetrical, allowing generally Identical positioning within the shoulder joints. This ensures proper form and alignment of the back throughout the exercise, minimizing the threat of injury and maximizing the isolation of the various abdominal muscles without any contortions of the arms or shoulders.

In the preferred embodiment and method of use, neither foot nor knee restraints are employed. This prevents the user from engaging her hip flexors, thereby maximizing and isolating the abdominal muscles. However, the user may choose to employ foot or knee restraints, such as if she employs heavy resistance.

While it is not expected to matter which of hand-grip portions 235, 236 extends upward and downward, the handles may be designed to rotate or pop in and out Alternately, handgrip portions 235, 236 may extend out In the y-axis direction.

The preferred embodiment includes three separate pads 221, 222, 223 that are circumferentially attached to straight bar 210 between and longitudinally outside of handles 231, 232, as shown most clearly in FIG. 2(*c*). These pads are preferably removable, secured onto place by Velcro or other means, so that they may be replaced when damaged or worn. The preferred pads are cylindrical; however, those skilled in the art will understand that other equivalent padding or cushion components or means may be substituted.

While not essential, rotating ends 211, 212 are preferably attached to each end of straight bar 210 to enable straight bar 210 to freely rotate along its longitudinal axis. This enables the bar to rotate so that it remains in the proper position against the user's chest throughout the crunch exercise. Rotating ends 211, 212 are preferably plastic or bronzed bushings between two steel parts (shaft and housing).

A configuration containing straight bar 210 and handles 231, 232 as generally described herein presents a core inventive concept of the present invention, and may be employed in a variety of abdominal exercise machines or devices. Similarly, the configuration of concave bar 110 along with handles 131, 132—as shown in FIGS. 1(*a*)-(*d*) and which is discussed in further detail below—similarly presents a core inventive concept that may be used in a variety of abdominal exercise machines One potential application not shown in the drawings is to use such a bar configuration in any stand-alone sitting abdominal crunch machine in which the bar is rigidly affixed to a rotating cam or similar means, such as those discussed in the background section, above. Employing such a bar with handles would provide an improvement to such machines by providing a comfortable position for the user to place his hands, thereby ensuring proper form throughout the crunch exercise. It would prevent the user's arms from flailing or moving about during the strain of exercising, particularly when approaching muscle exhaustion. It also would increase the user's comfort by transferring some of the pressure between the bar and the user's chest to the user's hands and handles.

However, the preferred embodiment of the present invention is an abdominal exercise accessory that may be separately purchased and used in a multi-exercise station of a universal-type exercise apparatus. These are the configurations shown in FIGS. 1 and 2, one with the preferred concave bar 110 shown in FIGS. 1(*a*)-(*d*), and the other having the simplified straight bar 210 shown in FIGS. 2(*a*)-(*d*).

Returning to FIG. 2, the abdominal accessory unit further comprises two side extensions 241, 242 that extend perpendicular and upward from the ends of straight bar 210 when straight bar 210 is positioned horizontally. Side extensions 241, 242 preferably comprise a rigid material, preferably metal. (Alternately, they may be comprised of a molded plastic or padded wooden material.) Side extensions 241, 242 extend about seven Inches, to which are attached angled extensions 251 and 252, respectively, via connectors 271, 272, respectively, which preferably is a spring link. Angled extensions 251, 252 converge at a point about 2.5 feet from straight bar 210, and are secured together by fastener 260, which preferably is a spring link. Angled extensions 251, 252 are preferably a flexible material, such as a cable. Alternately, angled extensions 251, 252 may be comprised of a rigid material, such as metal or molded plastic.

Fastener 260 may be secured to any overhead resistance means, preferably a standard overhead pulley-and-weight station (not shown). The user would employ whatever chair or bench is present at the station. While the chair or bench may include foot or knee restraints, the preferred method of use is to avoid using any such restraints.

An adjustable spacing cable, strap or other means (not shown) may be further included to permit the user to adjust the resting height of the attached abdominal accessory unit to coincide with user's seated height near but slightly above the appropriate initial vertical position for the exercise. If no adjustable or spacing cable is employed, the user would likely need to stand and grab straight bar 210 or handles 231, 232 and pull it downward while sitting on the bench or chair.

Turning now to FIG. 1—the preferred embodiment—we observe concave bar 110 is non-linear, having two portions that are symmetrically angled approximately 33 degrees relative to the longitudinal dimension of concave bar 110. As shown most clearly in FIG. 1(*b*), the angled portions of concave bar 11O are adjacent to pads 121 and 123, with the portion of concave bar 110 between handles 131, 132 remaining linear and parallel to the plane defined by the user's shoulders as she faces forward towards concave bar 110. The portions at the two longitudinal ends of concave bar 110 are preferably bent back so that they are parallel to the portion of concave bar 110 that is between handles 131, 132, and adjacent to pad 122. In this configuration, the remainder of the components (side extensions 141, 142, angled extensions 151, 152, connectors 171, 172, and fastener 160) are the same as the counterpart components in the design for the straight-bar configuration shown in FIG. 2 (i.e., side extensions 241, 242, angled extensions 251, 252, connectors 271, 272, and fastener 260, respectively). The only difference other than the shape of the bar is that the preferred embodiment of the straight-bar configuration includes rotating ends 211, 212 whereas the preferred embodiment of the concave-shaped bar configuration lacks this feature, and the drawings show slightly different shapes for handles 131, 132 and 231, 232—either of which may be used for either embodiment—although hand-grip portions 135, 136 and 235, 236 are preferably positioned in the same relative position in either embodiment, regardless of the shape of handles 131, 132 or 231, 232. The similarity in design permits the manufacture of both versions with minimal design changes.

Concave bar 110 may instead include continuously curved portions instead of discrete bending portions as shown in FIG. 1, to better conform to the contours of the human torso. This is not preferred, however, because it is not foreseen to be a significant improvement, relative to the added cost and complexity of the design and manufacture of the abdominal accessory unit, in part because pads 121, 122, 123 would need to be similarly curved, or be replaced by other padding means directly on concave bar 110. Also, any attempt to create a more exact match between the contour of concave bar 110 and the user's torso would be limited to one particular sized and shaped user. Nevertheless, such design modifications are within the scope and spirit of the present invention, and could be employed for specialty markets and applications not foreseen by the Applicants business model at the time this Application was filed.

Note that the house-shaped area defined and bordered by concave bar 110, side extensions 141, 142, and angled extensions 151, 152 is referred to as opening 180; and the house-shaped area defined and bordered by straight bar 210, side extensions 241, 242, and angled extensions 251, 252 is referred to as opening 280.

Finally, the various dimensions described herein constitute the best mode known to the Applicant for purposes of his business model and concomitant market. Those skilled in the art will appreciate that different dimensions would be more appropriate for different markets, and are within the scope and spirit of the present invention. Accordingly, these dimensions are not intended to limit the scope of invention or the claims that follow.

3. Methods of Using the Invention

There are two main techniques for using the present invention, a standard symmetrical crunch and a twisting crunch.

Figure 3:
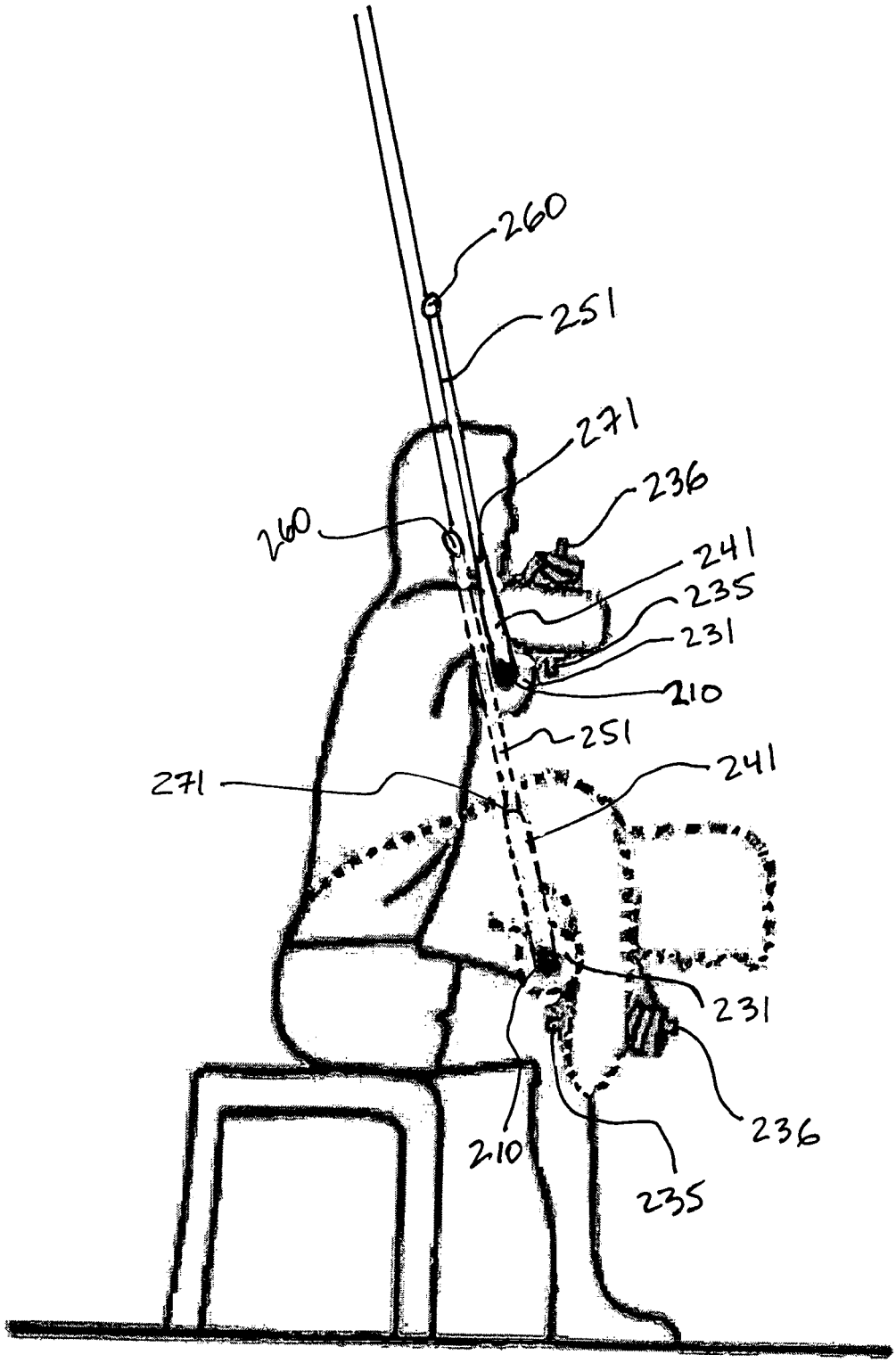
FIG. 3 shows a side view of a person sitting in the upright position using the straight bar configuration of FIG. 2, with perforated lines showing the person and the bar configuration as he bends forward symmetrically, performing a standard crunch exercise of the present invention.

A standard symmetrical crunch is shown in FIG. 3, which depicts the straight-bar configuration shown FIG. 2, although this crunch may similarly be performed with the concave-bar configuration shown in FIG. 1. The user begins by inserting his arms and head through opening 280, crossing or overlapping his forearms, and grasping handle 231 on hand-grip portion 235 with his left hand, and grasping handle 232 on hand-grip portion 236 with his right hand, with his chest pressed against pads 221, 222, 223. This positions the user's upper arms in a generally perpendicular position relative to the front of his torso. Next, the user—preferably from a sitting position on a bench or seat—rotates his upper body forward and down towards his thighs, accordingly pulling straight bar 210 forward and down towards his thighs, which activates the resistance attached to fastener 260 (not shown), typically lifting a stack of weights attached to a pulley-and-cable weight station. In the preferred method, the user only bends his torso about half way towards his thighs—and not to his knees—to maintain a continuous and substantial stress to the abdominal muscles. (Alternately, the user may instead perform the exercise from a kneeling or standing position instead of from a sitting position.)

During the rotation, the user's shoulders and straight bar 210 remain perpendicular relative to plane defined by the front of the user's chest from the initial upright, forward-facing sitting position. In other words, assuming the user's legs are parallel, with his knees adjacent to each other, straight bar 210 will remain substantially parallel to the plane defined by the user's legs, and each of the user's elbows will remain substantially the same distance from each corresponding thigh throughout the rotating downward In other words, the user's torso remains symmetrical throughout the rotation or crunch motion.

In the straight-bar configuration that includes rotating ends 211, 212, the bar-handle configuration (straight bar 210 and handles 231, 232) swivel slightly throughout the rotation downward to maintain its proper alignment with the user's chest and underarm area.

While not shown in FIG. 3, the bench or seat system of the particular exercise station may have foot or knee restraints to provide sufficient leverage for the user to employ heavy resistance relative to his body weight, although this is not the preferred embodiment. In the preferred method of use, the user would not use any such restraints if possible.

The same symmetrical crunch method of use may be performed with the concave-bar configuration shown in FIG. 1. In that case, the user inserts his arms and head through opening 180, grasps handle 131 with his left hand, handle 132 with his right hand, presses his chest against pads 121, 122, 123, and pivots forward, activating the resistance attached to fastener 160. There are no discernable differences other than that concave bar 110 and pads 121, 122, 123 wrap around and press against a greater portion of the user's chest, and better fit under the user's underarms, and the absence of rotating ends between concave bar 110 and side extensions 141,142.

While FIG. 3 depicts the abdominal exercise accessory configuration of the preferred embodiment of the present invention, the standard symmetrical crunch may be performed in a similar manner if either the straight- or concave-bar configurations are incorporated in a stand-alone isometric crunch weight machine in which concave bar 110 or straight bar 210 (as the case may be) is rigidly attached to a rotating cam, preferably either along the longitudinal ends of concave bar 110 or rotating ends 211, 212. While there are no side extensions 141, 142 or 241, 242, angled extensions 151, 152 or 251, 252 or resulting opening 180 or 280 in such a configuration, the user crosses his forearms in the same overlapping position and secures each of his hands to hand-grip portions 135, 136 or 235, 236, presses his chest against concave bar 110 or straight bar 210, and rotates his torso forward and down towards his thighs.

Due to the rigid attachment of concave bar 110 or straight bar 210 to a rotating cam or other pivoting means in such a machine, the apparatus limits the method of use to a symmetrical rotation or crunch because in such a configuration, concave bar 110 or straight bar 210 cannot twist along any axis that is perpendicular to the mean longitudinal direction of concave bar 110 or straight bar 210. Concave bar 110 or straight bar 210 could only rotate along its longitudinal axis. Similarly, the pathway of concave bar 110 or straight bar 210 through the rotation or crunch is forced to be a uniformly circular arc of a fixed radius (most machines allow the user to adjust the radius to his particular height, although the selected radius remains fixed throughout the exercise). The preferred embodiment employs a cable that allows concave bar 110 or straight bar 210 to move and twist or rotate in any direction, thereby allowing its pathway to follow a non-uniform curved arc downward to conform to the natural motion of the user's body as he bends forward during the exercise, ensuring better form, greater comfort, and better isolating the abdominal muscles.

Figure 4:
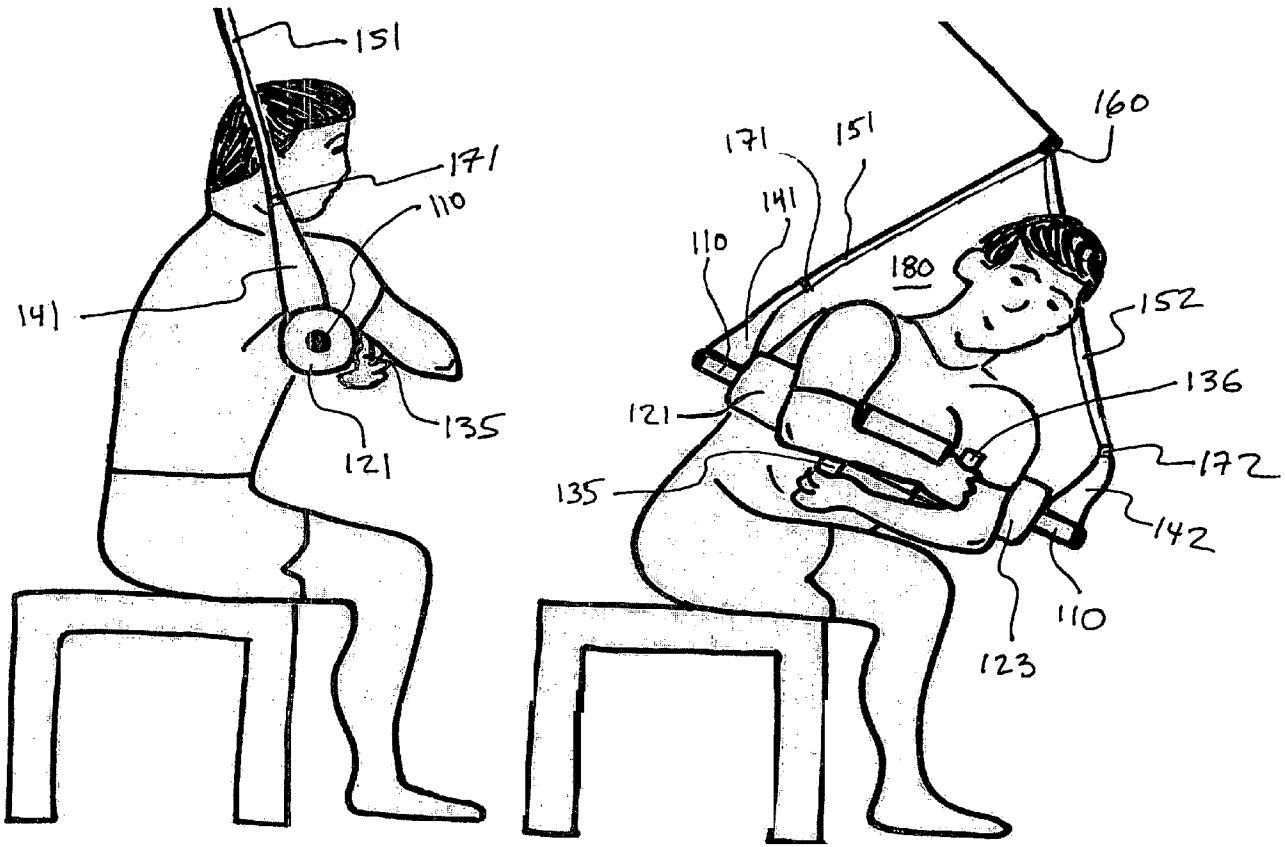
FIG. 4 shows a side view of a person sitting in the upright position using the concave bar configuration of FIG. 1, and a second side view showing the user and the bar configuration as the user bends forward towards his thighs while simultaneously twisting or rotating to his right side, performing a twisting crunch exercise of the present invention.

A twisting crunch is shown in FIG. 4, which depicts the concave-bar configuration of FIG. 1. The method of use is the same as the standard symmetrical crunch described above, with the one exception that as the user rotates his torso forward and downward towards his thighs, he slowly and continuously twists his torso to either the right or left so that his left elbow moves generally over and towards his right knee or thigh-region adjacent to the knee (as shown in FIG. 4), or so that his right elbow moves generally over and towards his left thigh, as the case may be. The user may alternate between right and left twisting crunches to build and strengthen the abdominal muscles on both sides of his body evenly.

The advantage of a twisting crunch is that it isolates the abdominal muscle regions that are farther away from the centerline of the user's body. The most effective abdominal work out would include both symmetrical and twisting crunches.

Note that the preferred embodiment entails connecting the invention to a single overhead resistance station, such as a standard overhead weight-and-pulley station that is well known to those in the art However, alternate configurations of the invention may be employed with a double-cable pulley-and-weight station in which the longitudinal ends of straight bar 210 or concave bar 110 may be directly attached to each of cable of the double-cable station. Or a configuration having side extensions 141, 142 or 241, 242 could be attached to a double-able station by the ends of side extensions 141, 142 or 241, 242 opposite straight bar 210 or concave bar 110, as the case may be.

Additional advantages and modifications will readily occur to those skilled in the art Thus while the preferred embodiment of the present invention has been disclosed and described herein, the invention in its broader aspects is not limited to the specific details, methods and representative devices shown and described herein. It will be understood by those skilled in the art that various changes in form and detail may be made therein without departing from the spirit and scope of the general inventive concept as defined by the appended claims and their equivalents.

We claim:

1. An abdominal exercise apparatus comprising:

a rigid cross-sectional bar that is concave two handles, each spaced apart from each other and attached to the cross-sectional bar; and a hand-grip portion on each handle; and wherein—in a 3-dimensional coordinate system having an x-, y- and z- axis in which the x-axis is defined as the longitudinal dimension of the cross-sectional bar at its center, and in which each axis is perpendicular to the other two—the cross-sectional bar is capable of being placed adjacent to a person's chest and cradled within and extending completely across and beyond the person's underarm region, with each of the person's hands grasping onto each hand-grip portion such that the person can perform an abdominal exercise using the cross-sectional bar.

2. The abdominal exercise apparatus of claim 1 further comprising a side extension attached to each longitudinal end of the cross-sectional bar and angled within 20 degrees of being perpendicular to the ends of the cross-sectional bar; and an angled extension attached to each side extension opposite the cross-sectional bar, and in which the ends of each angled extension opposite the cross-sectional bar are connected to each other; and wherein the cross-sectional bar, side extensions and angled extensions form an opening through which a person's arms, head and upper torso may be extended.

3. The abdominal exercise apparatus of claim 2 in which the angled extensions are attached to an overhead pulley-and-cable station that provides adjustable resistance to the cross-sectional bar when pulled generally in the opposite direction of the overhead pulley-and-cable station.

4. The abdominal exercise apparatus of claim 2 in which the angled extensions are made of a flexible material.

5. The abdominal exercise apparatus of claim 2 further comprising cushioned pads attached to the cross-sectional bar.

6. The abdominal exercise apparatus of claim 5 in which the handles are rigidly attached to the cross-sectional bar.

7. The abdominal exercise apparatus of claim 2 in which the longitudinal dimension of each hand-grip portion is within 30 degrees of the z-axis dimension.

8. The abdominal exercise apparatus of claim 7 in which the hand-grip portions are positioned at least six inches apart along the x-axis.

9. The abdominal exercise apparatus of claim 8 in which the hand-grip portions are positioned at least one inch from cross-sectional bar in the y-axis dimension from a line defined by the longitudinal midpoint of the cross-sectional bar.

10. The abdominal exercise apparatus of claim 1 in which the hand-grip portions are positioned at least six inches apart along the x-axis.

11. An abdominal exercise apparatus comprising:

a rigid cross-sectional bar;

two handles, each spaced apart from each other and attached to the cross-sectional bar; and a hand-grip portion on each handle; and wherein the cross-sectional bar is capable of being placed adjacent to a person's chest and cradled within and extending completely across and beyond the person's underarm region, with each of the person's hands grasping onto each hand-grip portion such that the person can perform an abdominal exercise using the cross-sectional bar; and wherein the abdominal exercise apparatus further comprises resistance means in the z-axis dimension such that the cross-sectional bar is freely moveable in x- and y-axes dimensions.

12. An abdominal exercise apparatus comprising:

a rigid cross-sectional bar;

two handles, each spaced apart from each other and attached to the cross-sectional bar; and a hand-grip portion on each handle;

a side extension attached to each longitudinal end of the cross-sectional bar and angled within 20 degrees of being perpendicular to the ends of the cross-sectional bar; and an angled extension attached to each side extension opposite the cross-sectional bar, and in which the ends of each angled extension opposite the cross-sectional bar are connected to each other; and wherein the cross-sectional bar, side extensions and angled extensions form an opening through which a person's arms, head and upper torso may be extended; and wherein the cross-sectional bar is capable of being placed adjacent to a person's chest and cradled within and extending completely across and beyond the person's underarm region, with each of the person's hands grasping onto each hand-grip portion such that the person can perform an abdominal exercise using the cross-sectional bar.

13. The abdominal exercise apparatus of claim 12 in which the side extensions freely pivot relative to the longitudinal ends of the cross-sectional bar.

14. An abdominal exercise apparatus comprising:

a rigid cross-sectional bar having cushioned pads attached to the cross-sectional bar;

two handles, each spaced apart from each other and attached to the cross-sectional bar;

a hand-grip portion on each handle;

a side extension attached to each longitudinal end of the cross-sectional bar and angled within 20 degrees of being perpendicular to the ends of the cross-sectional bar; and an angled extension attached to each side extension opposite the cross-sectional bar, and in which the ends of each angled extension opposite the cross-sectional bar are connected to each other; and wherein the cross-sectional bar, side extensions and angled extensions form an opening through which a person's arms, head and upper torso may be extended, and wherein the cross-sectional bar is capable of being placed adjacent to a person's chest and cradled within and extending completely across and beyond the person's underarm region, with each of the person's hands grasping onto each hand-grip portion such that the person can perform an abdominal exercise using the cross-sectional bar.

15. A method of using an abdominal exercise apparatus having a rigid cross-sectional bar and at least one handle attached to and extending from the cross-sectional bar, wherein the at least one handle comprises at least one portion to be gripped by two hands; comprising the steps:

positioning the bar against one's chest and cradled within and extending completely across and beyond one's underarms;

gripping the handle; and rotating one's torso forward and downward, moving one's shoulders generally toward one's thighs; and wherein the rotating step moves the bar generally opposite resistance that is applied to the bar.

16. The method of using an abdominal exercise apparatus of claim 15 in which one's forearms overlap in a generally parallel position, opposite one's chest, when gripping the handle.

17. The method of using an abdominal exercise apparatus of claim 15 in which the rotating step causes the bar to travel along a circular pathway.

18. The method of using an abdominal exercise apparatus of claim 15 in which the rotating step causes the bar to travel along a non-circular pathway.

19. The method of using an abdominal exercise apparatus of claim 15 in which each longitudinal end of the bar is attached to a cable in a double-able pulley-and-weight station.

20. The method of using an abdominal exercise apparatus of claim 15 in which the bar is concave shaped to match the general contours of the user's torso when positioning the bar against the user's chest.

21. The method of using an abdominal exercise apparatus of claim 15 in which the apparatus further includes structural elements attached to the longitudinal ends of the bar, and connected opposite the bar, thereby forming an opening, and further comprising the step of inserting one's arms, head and upper torso through the opening prior to the rotating step.

22. The method of using an abdominal exercise apparatus of claim 21 in which the structural elements are connected to an overhead pulley-and-weight station.

23. The method of using an abdominal exercise apparatus of claim 15 further comprising the step of twisting one's torso to either side while simultaneously performing the rotating step, thereby rotating downward by bending at the hips and back generally towards one's thighs while also twisting towards one side, such that one elbow moves closer to the opposite thigh.

24. The method of using an abdominal exercise apparatus of claim 23 in which the rotating step causes the bar to travel along a circular pathway.

25. The method of using an abdominal exercise apparatus of claim 23 in which the rotating step causes the bar to travel along a non-circular pathway.

26. The method of using an abdominal exercise apparatus of claim 23 in which the bar is concave shaped to match the general contours of the user's torso when positioning the bar against the users chest.

27. An abdominal exercise apparatus comprising:

a rigid cross-sectional bar;

a cushioned pad attached to the cross-sectional bar;

a handle with at least one hand grip portion;

a side extension attached to each longitudinal end of the cross-sectional bar and angled within 20 degrees of being perpendicular to the ends of the cross-sectional bar; and an angled extension attached to each side extension opposite the cross-sectional bar, and in which the ends of each angled extension opposite the cross-sectional bar are connected to each other; and wherein the cross-sectional bar, side extensions and angled extensions form an opening through which a person's arms, head and upper torso may be extended; and wherein the bar is capable of being placed adjacent to a person's chest and cradled within and extending completely across and beyond the person's underarm region.

28. An abdominal exercise apparatus comprising:

a rigid cross-sectional bar that is freely moveable in all three dimensions in space when resistance is applied to the cross-sectional bar;

a cushioned pad attached to the cross-sectional bar; and a handle with at least one hand grip portion;

wherein the cross-sectional bar is capable of being placed adjacent to a person's chest and cradled within and extending completely across and beyond the person's underarm region.

* * * * *